US006530791B1

(12) United States Patent
Hierzer

(10) Patent No.: US 6,530,791 B1
(45) Date of Patent: Mar. 11, 2003

(54) COUPLING FOR CONDUCTOR BARS

(76) Inventor: Andreas Hierzer, Auer-Welsbach-Gasse 36, A-8055 Graz (AT)

( * ) Notice: Subject to any disclaimer, the term of this patent is extended or adjusted under 35 U.S.C. 154(b) by 0 days.

(21) Appl. No.: 10/048,259

(22) PCT Filed: Jul. 17, 2000

(86) PCT No.: PCT/AT00/00196

§ 371 (c)(1),
(2), (4) Date: Jan. 28, 2002

(87) PCT Pub. No.: WO01/09987

PCT Pub. Date: Feb. 8, 2001

(30) Foreign Application Priority Data

Jul. 30, 1999 (AT) ..... 1321/99

(51) Int. Cl.[7] ..... H01R 25/00
(52) U.S. Cl. ..... 439/115
(58) Field of Search ..... 439/115, 210, 439/213, 11, 31

(56) References Cited

U.S. PATENT DOCUMENTS 2,447,026 A 8/1948 O'Brien et al.
4,239,932 A * 12/1980 Textoris et al. ..... 439/115
5,322,444 A * 6/1994 Audehm et al. ..... 439/210

FOREIGN PATENT DOCUMENTS

| | | |
|---|---|---|
| DE | 2131065 | 1/1973 |
| DE | 2714467 | 10/1977 |
| DE | 9641090 | 4/1997 |
| DE | 9750100 | 6/1999 |

* cited by examiner

*Primary Examiner*—Gary Paumen
(74) *Attorney, Agent, or Firm*—Ladas & Parry

(57) ABSTRACT

Described is a coupling for conductor rails. The coupling (1) comprises a middle unit (2) which in turn has two pivoting parts (13, 14) pivotable relative to each other, one holding means (3, 4) for a conductor rail (5) being provided on each of these pivoting parts (13, 14). The holding means (3, 4) are provided with electrical connecting conductors (15) which serve for a connection with the conductor rails (5) to be applied to these holding means (3, 4). The individual connecting conductors (15) of the holding means (3, 4) have the form of electrically conductive rods which extend from the holding means (3, 4) into the interior of the pivoting parts of the middle unit (2), one connecting conductor of one holding means (3) each slidingly abutting on a connecting conductor of the other holding means (4). Preferably, the connecting conductors have a ring at each one of their inner ends, one ring of a connecting conductor each slidingly abutting on a ring of another connecting conductor.

8 Claims, 3 Drawing Sheets

COUPLING FOR CONDUCTOR BARS

The invention relates to a coupling for conductor rails, which coupling comprises a middle unit having two pivoting parts pivotable relative to each other about a geometric pivot axis, the pivoting parts being cup-shaped, facing each other with their open sides, and being assembled by rims abutting each other or overlapping each other, one respective holding means for a cantilevering multipole conductor rail for attachment of lighting fixtures being arranged on each one of these pivoting parts so as to project from the outer side of the pivoting parts in a radial direction with respect to the pivot axis, said holding means being provided with electrical connecting conductors for a connection with conductor rails to be attached there, and wherein the individual connecting conductors of the one holding means are each electrically conductively connected with a connecting conductor of the other holding means.

Couplings of the afore-mentioned type mainly serve to assemble conductor rails which in turn are provided for attaching and supplying an electric current to lighting fixtures, in a manner that a conductor rail will be available at those sites where, following a given plan, lighting fixtures are to be arranged, so as to provide them with electric current. Couplings of the afore-mentioned type are known from DE 21 31 065 B. With the latter it is possible to interconnect conductor rails at selectable angular positions relative to each other. In these known couplings, a respective connecting conductor of one holding means is conductively connected with a connecting conductor of the other holding means via a flexible cable which is guided through the middle unit. This embodiment is comparatively complicated as regards the production of the individual parts of the coupling and also as regards its assembly, and mention may be made of the necessity of connecting the flexible cables with the connecting conductors and the required manipulations when inserting the connecting conductor pairs which are interconnected via these cables, in the holding means. Moreover, also the accommodation of the flexible cables in the middle unit often is difficult because these cables, particularly when they are to conduct higher amperages, must be comparatively thick, the required insulation of these cables further increasing the thickness of the latter, and since, considering the required pivotability of the holding means relative to each other, the length of these flexible cables to be housed in the middle unit must be rather large; the latter may also impede the movability of the holding means relative to each other.

It is an object of the present invention to provide a configuration of a coupling of the initially defined kind in which the afore-mentioned disadvantages are avoided.

The inventive coupling of the initially defined kind is characterized in that the connecting conductors are formed as electrically conductive rods extending from the holding means into the interior of the pivoting parts of the middle unit, wherein, in the vicinity of the pivot axis, a respective connecting conductor of one holding means slidingly contacts a connecting conductor of the other holding means. By this configuration, the object set out above can well be met in a simple manner. A structurally simple coupling is obtained the parts of which can be produced with little expenditures and can be assembled with a simple manipulation and which is also easily adjustable when in use, a good electrical connection of the connecting conductors one to another being provided. Particularly with a view to mounting the individual construction parts, a suitable embodiment results if it is provided that a connecting conductor leads directly from each holding means, in the half attached on one of the pivoting parts, into the interior of this pivoting part, and a connecting conductor from the other half of the respective holding means leads into the interior of the respective other pivoting part, passing the gap between this half and the respective other pivoting part of the middle unit through a peripherally extending slot in the wall of the respective other pivoting part. In this respect, it is possible to provide for a very good electrical contact between the electrical pathways leading from the one holding means to the other holding means in a structurally simple manner and over long periods of time with an embodiment which is characterized in that the ends of the connecting conductors located in the interior of the pivoting parts of the middle unit each carry a ring which surrounds the pivot axis, a respective ring of a connecting conductor of the one holding means slidingly contacting a ring of a connecting conductor of the other holding means. This embodiment also ensures a good positioning of the connecting conductors over extended periods of time. This embodiment may also advantageously be supplemented in that an annular insulating spacer which likewise surrounds the pivot axis is arranged between pairs of slidingly abutting rings.

For providing the contact between the connecting conductors in the holding means of the coupling and the conductor rails to be applied to these holding means it is suitable if it is provided that the connecting conductors are mounted in the holding means so as to be transversely displaceable and designed to be resilient in transverse direction. A transversely displaceable and resilient mounting of the connecting conductors may also advantageously be obtained with an embodiment which is characterized in that the connecting conductors are mounted in the holding means so as to be transversely displaceable therein and in that springs are provided which act in transverse direction of the connecting conductors and engage on the connecting conductors.

For the production and assembly of the individual parts which, in the coupling designed according to the invention, are particularly important with respect to the structure, i.e. the two parts of the middle unit which are pivotable relative to each other, and the holding means, it is particularly advantageous if it is provided that each one of the holding means is formed by an attachment part directly located on one of the two pivoting parts of the middle unit and an externally following plug-in connection part to which a conductor rail can be attached by positive connection. Furthermore, this embodiment also has the advantage that for an adaptation to various forms of conductor rails it is merely necessary to design the plug-in connection parts in conformity with the rails, whereas the middle unit with the attachment parts does not require an adaptation to the shape of the conductor rail; moreover, by providing attachment parts directly located on the mutually pivotable parts of the middle unit, as well as plug-in connection parts following these attachment parts in outward direction, mounting of the holding means with their electrical connecting ledges on the mutually pivotable parts of the middle unit is substantially facilitated. Advantageously, the attachment part may be integrally formed in one piece with its associated pivoting part.

The invention will now be described in more detail and with reference to examples schematically illustrated in the drawings. In the drawings, FIG. 1 shows a view of a preferred exemplary embodiment of a coupling designed according to the invention;

Figure 1:
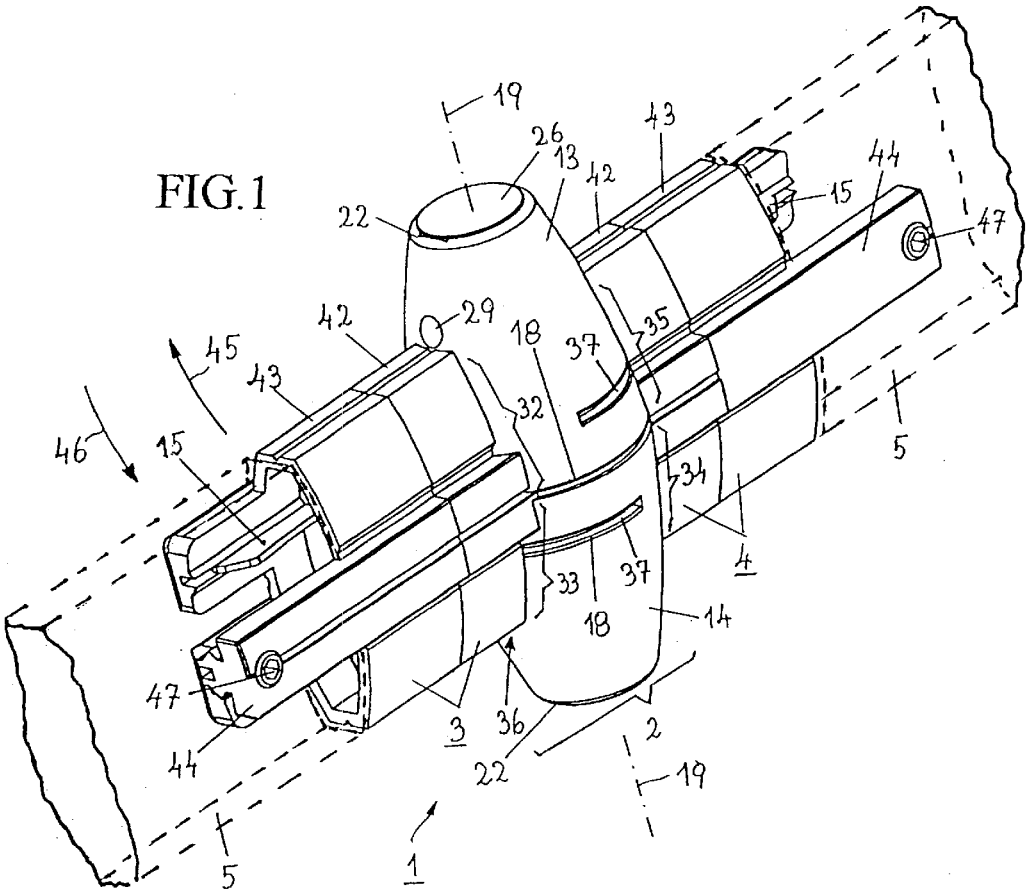

The embodiment of a coupling 1 designed according to the invention and illustrated in FIG. 1 comprises a middle unit 2 on which two holding means 3, 4 are arranged which are designed to mechanically and electrically interconnect conductor rails 5 applied to these holding means. Such conductor rails 5 which are indicated in broken lines in FIG. 1 comprise at least two conductors electrically insulated from each other and are generally provided for a cantilevered arrangement and for the supply of current to lighting fixtures which will be connected to the conductors of the conductor rails.

Figure 2:
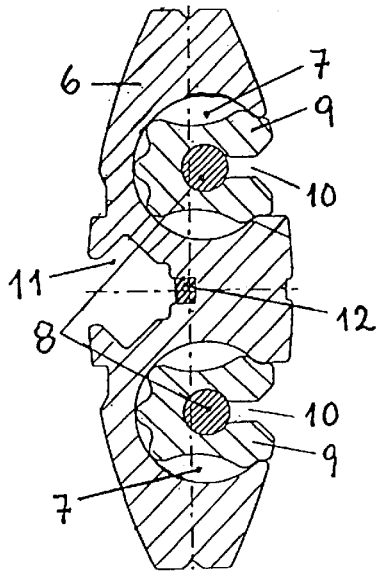
FIG. 2 shows an example of a conductor rail provided to be attached to a coupling according to the invention.

An example of such a conductor rail 5 is illustrated in section in FIG. 2. The conductor rail comprises a basic section rod 6 having longitudinally extending recesses 7 which in turn receive conductors 8. The conductors 8 are held in the longitudinally extending recesses 7 by insulating sections 9. The insulating sections 9 have a slot 10 opening towards the outside through which the conductors 8 may be contacted from the outside for supplying and removing an electrical current by means of pin-like or ledge-like connecting conductors. On the opposite side of the basic section rod 6, a further section groove 11 is provided in which a section rod can be inserted to mechanically retain the conductor rail. If desired, a further conductor 12 may be arranged at the bottom of the section groove 11, which is possible without any further insulating measures if the basic section rod 6 itself is made of an insulating material. If, however, the basic section rod 6 is made of metal, it may itself serve as a conductor, and then particularly its use as a zero conductor or as a conductor to ground may be considered.

The middle unit 2 comprises two pivoting parts 13, 14 pivotable relative to each other about a geometrical pivot axis 19 indicated in broken lines. On one pivoting part 13 the holding means 3, and on the other pivoting part 14 the holding means 4 is arranged. Within the holding means 3, 4, connecting conductors 15 are arranged which provide for an electric connection from the conductors of a conductor rail applied to the holding means 3 to the conductors of another conductor rail applied to the holding means 4. For this purpose, the individual connecting conductors of the holding means 3 are each electrically conductively connected with a connecting conductor of the holding means 4 via a pivotable connection not illustrated in detail in FIG. 1 and arranged in the interior of the middle unit 2.

Figure 3:
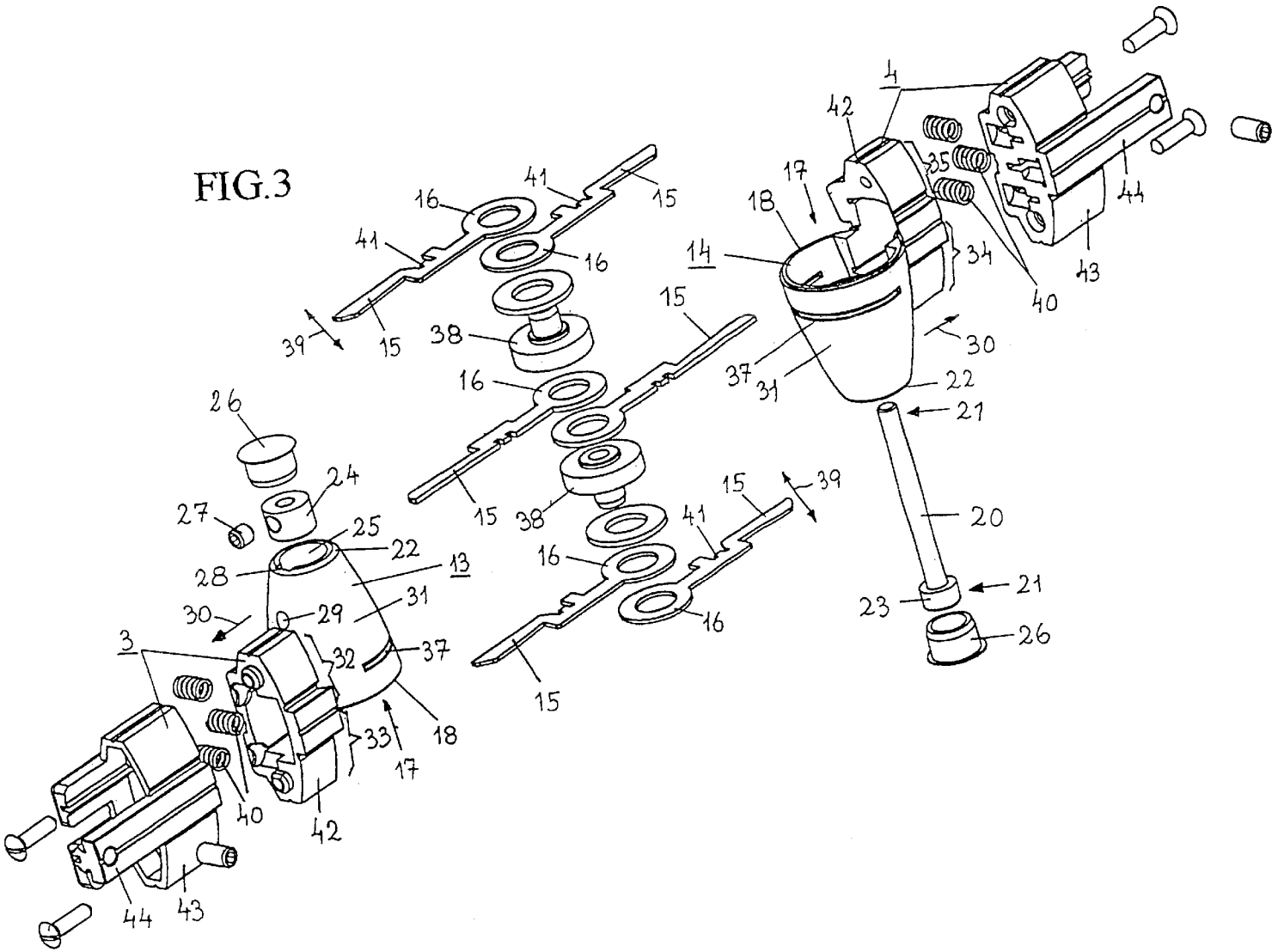
FIG. 3 shows the individual parts of the coupling illustrated in FIG. 1 in an exploded view.

As is apparent from FIGS. 1 and 3, the two pivoting parts 13, 14 of the middle unit 2 are cup-shaped, facing each other with their open sides 17, and are assembled with their mutually abutting rims 18. The pivot axis in this case is physically embodied by a rod 20 arranged in the interior of the two cup-shaped pivoting parts 13, 14 of the middle unit 2, the ends 21 of the rod being each connected with one of the bottom zones 22 of the cup-shaped pivoting parts 13, 14, which bottom zones are located so as to face away from each other. In one case this connection is formed by a collar 23 provided on one end of the rod 20 and received by a corresponding widening of a through-bore in the bottom zone of pivoting part 14, and in the other case it is formed by an adjustment ring 24 received by a widening 25 of a through-bore in the bottom zone of pivoting part 14; in the case illustrated, the aforementioned through-bores are outwardly closed by plugs 26. The adjustment ring 24 can be fixed on the rod 20 by means of a screw 27, a groove 28 allowing for an axial insertion of the adjustment ring 24 in the widening 25 until the screw has reached an opening 29 through which a tool can be introduced so as to tighten the screw 27. Depending on the length of the screw 27, the pivoting part 13 may be fixed or may be pivotable relative to the rod 20 when the screw is tightened.

The holding means 3, 4 are arranged on the cup-shaped pivoting parts 13, 14 so as to project from the outer side 31 thereof in a radial direction relative to the pivot axis 19, as is indicated by arrows 30. If desired, also other modes of arranging these holding means are feasible, e.g. an arrangement in tangential direction so that in that case conductor rails to be applied to the holding means 3, 4 likewise will assume a direction tangential to the outer side of the pivoting parts 13, 14.

Viewed in the direction of the pivot axis 19, the holding means 3, 4 are arranged so as to be approximately symmetrical with respect to the plane extending through the rims 18 of the pivoting parts 13, 14, with the half 32 of the holding means 3 that lies on one side of the above-mentioned plane being attached to the pivoting part 13, and with its other half 33 which lies at the other side of the above-mentioned plane, being located in front of the pivoting part 14; analogously thereto, the holding means 4 with its half 34 is attached to pivoting part 14, and with its half 35 it is located in front of pivoting part 13. The connecting conductors 15 have the form of electrically conducting rods projecting from the holding means 3, 4 into the interior of the pivoting parts 13, 14 of the middle unit 2, wherein in the vicinity of the pivot axis 19, a respective connecting conductor of the one holding means 3 slidingly contacts a respective connecting conductor of the other holding means 4. Here it is preferred that from each holding means 3, 4, in its half 32, or 34, respectively, attached to the associated pivoting part 13, or 14, respectively, a connecting conductor 15 leads directly into the interior of the respective pivoting part 13, or 14, respectively, and that a further connecting conductor leads from the other half 33, or 35, respectively, of the respective holding means 3, or 4, respectively, by passing the gap 36 between the respective other half 33, or 35, respectively, and the respective other pivoting part 14, or 13, respectively, through a peripherally extending slot 37 in the wall of the respective other pivoting part 14, or 13, respectively, into the interior thereof. By an appropriately wide design of the holding means 3, 4, sufficient safety against a contact of the connecting conductors 15 guided through the slots 37 can be achieved.

To provide for a good electrical connection between the slidingly abutting ends of connecting conductors and to simultaneously achieve a structurally simple and secure positioning of the connecting conductors, in the case illustrated the ends of the connecting conductors 15 located within the pivoting parts 13, 14 are each provided with a ring 16 surrounding the pivot axis, one ring of a connecting conductor of one holding means each slidingly abutting on one ring of a connecting conductor of the other holding means. Between pairs of slidingly abutting rings 16, one annular, insulating spacer 38 is provided which likewise surrounds the pivot axis 19, or 20, respectively.

In the holding means 3, 4, grooves are provided in which the connecting conductors 15 are mounted so as to be displaceable in transverse direction. The connecting conductors are resilient in the transverse direction which is indicated by arrow 39 so as to ensure a snugly fitting electrical contact with the conductors 8 of the conductor rails 5. In the case illustrated, springs 40 acting in the transverse direction 39 of the connecting conductors 15 are provided which are arranged in chambers of the holding means 3, 4 and which act on the connecting conductors 15 at sites of engagement designated by 41. To simplify the production of parts, to simplify mounting thereof, and to allow for a simple adaptation of such couplings to various conductor rails, each of the holding means 3, 4 is formed of an attachment part 42 directly located on one of the two pivoting parts 13, 14 of the middle unit 2 and of an externally following plug-in connection part 43 to which a conductor rail can be attached by a positive connection. In the case illustrated, the holding means 3, 4 are provided with a section rod 44 provided to mechanically guide and retain conductor rails 5 to be attached to the coupling and fitting into a respective section groove 11 of a conductor rail. Preferably, also this section rod has a groove, as is illustrated, in which a connecting conductor may be inserted if a further electrically conductive connection, such as, e.g., a zero conductor connection or a connection to ground, is desired.

Figure 4:
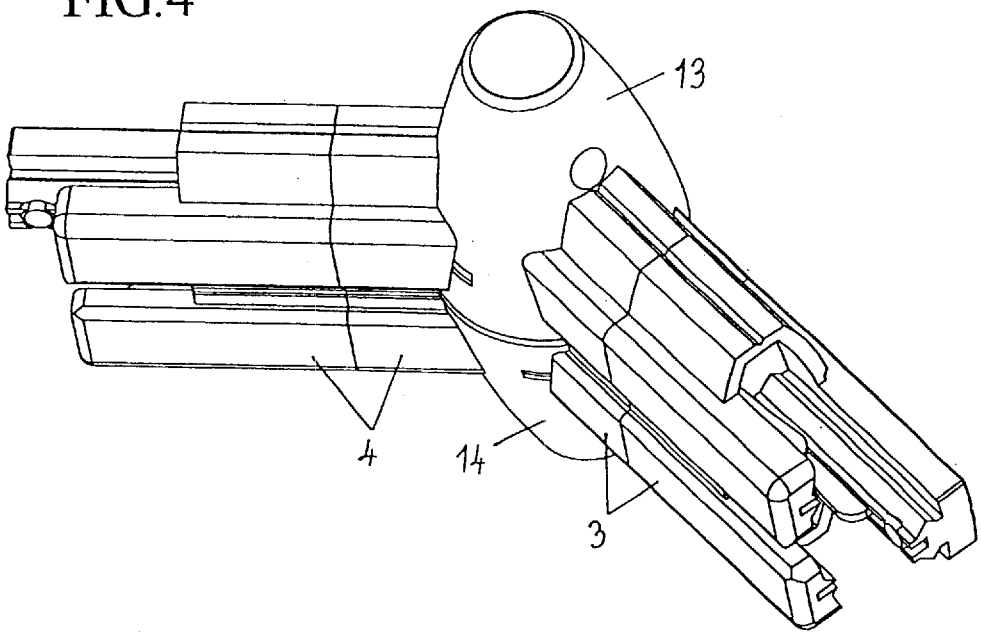
FIGS. 4 and 5 show views of the coupling illustrated in FIG. 1 in pivoted positions differing from the illustration of FIG. 1.
Figure 5:
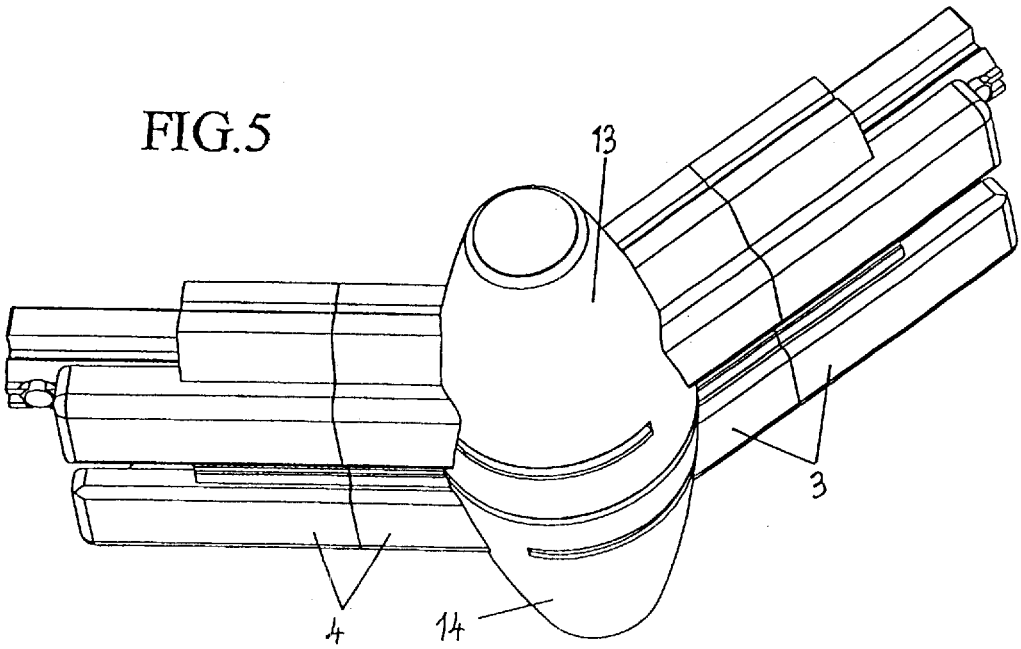

FIGS. 4 and 5 show the coupling according to FIG. 1 in pivoted positions different from FIG. 1. In the position illustrated in FIG. 1, the holding means 3, 4 are in alignment with each other. According to FIGS. 4 and 5, the pivoting parts 13, 14 and thus also the holding means 3, 4, are pivoted relative to each other about the geometric axis 19, to the position according FIG. 4 in the direction of the arrow 45, and to the position according to FIG. 5 in the direction of arrow Thus conductor rails 5 which are to be arranged at angle to each other can be interconnected without problems by pivoting the pivoting parts 13, 14 including the holding means 3, 4 into a position suitable the intended course of the conductor rails. Screws may be provided so as to fix conductor rails 5 to holding means 3, 4.

What is claimed is:

1. A coupling arrangement for conductor rails, said coupling arrangement comprising a middle unit formed by two cup-shaped pivoting parts, each cup-shaped pivoting part having an open side and a wall provided with a peripheral slot, the cup-shaped parts facing each other with their open sides and being assembled at said open sides, a geometrical pivot axis extending perpendicular to a plane defined by said open sides of said cup-shaped pivoting parts in the middle of said open sides of said cup-shaped pivoting parts, and said pivoting parts being pivotable relative to each other about said geometrical pivot axis, a holding means externally arranged on each of said pivoting parts so as to outwardly project from its respective pivoting part in radial direction with respect to the pivot axis, said holding means being provided for a multipolar cantilevered conductor rail for an attachment of lighting fixtures, each holding means having two halves, one half being attached to one respective pivoting part, an electrical connecting conductor having the form of an electrically conducting rod provided in each holding means for making a connection with a conductor rail to be attached thereto, each individual connecting conductor of the one holding means being electrically conductively connected with a connecting conductor of the respective other holding means by extending from its associated holding means into the interior of its associated pivoting part of said middle unit so as to slidingly contact said connecting conductor of the respective other holding means near said pivot axis, a respective connecting conductor leading from the half of its holding means attached to the associated pivoting part of said middle unit directly into the interior of said pivoting part, and a respective connecting conductor of the other half of said same holding means leading into the interior of the respective other pivoting part of said middle unit by passing a gap between the other half of said same holding means and the respective other pivoting part of the middle unit and by passing through said peripheral slot in said wall of the respective.other pivoting part of said middle unit.

2. A coupling arrangement as set forth in claim 1, wherein said open sides of said two cup-shaped pivoting parts are assembled with their rims abutting on each other.

3. A coupling arrangement as set forth in claim 1, wherein said open sides of said two cup-shaped pivoting parts are assembled with their rims overlapping each other.

4. A coupling arrangement as set forth in claim 1, further comprising a ring provided on each end of a connecting conductor located in the interior of said pivoting parts of said middle unit, said ring surrounding said pivot axis, the ring of one respective connecting conductor of the one holding means slidingly contacting the ring of a connecting conductor of the respective other holding means.

5. A coupling arrangement as set forth in claim 4, further comprising an annular insulating spacer located between pairs of slidingly contacting rings, said spacer also surrounding said pivot axis.

6. A coupling arrangement as set forth in claim 1, wherein said connecting conductors are mounted in said holding means so as to be transversely displaceable therein, said connecting conductors being resilient in transverse direction.

7. A coupling arrangement as set forth in claim 6, further comprising springs acting in transverse direction of said connecting conductors, said springs engaging at the connecting conductors, on the one hand, and on the respective holding means, on the other hand.

8. A coupling arrangement as set forth in claim 1, wherein each holding means is comprised of an attachment part directly located on one of the two pivoting parts of said middle unit, and of an outwardly following plug-in connection part, a respective conductor rail being connectable to said plug-in connection part by positive connection.

* * * * *